US008695232B2

(12) United States Patent
Choi et al.

(10) Patent No.: US 8,695,232 B2
(45) Date of Patent: Apr. 15, 2014

(54) DRYER

(75) Inventors: Chul Jin Choi, Changwon-si (KR); Sang Hun Bae, Changwon-si (KR); Yang Hwan Kim, Changwon-si (KR); Tae Hee Lee, Changwon-si (KR); Min Ji Kim, Changwon-si (KR); Ku Young Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 707 days.

(21) Appl. No.: 12/289,022

(22) Filed: Oct. 17, 2008

(65) Prior Publication Data

US 2009/0113745 A1 May 7, 2009

(30) Foreign Application Priority Data

Nov. 2, 2007 (KR) ..... 10-2007-0111378
Nov. 12, 2007 (KR) ..... 10-2007-0114754

(51) Int. Cl.
*F26B 11/02* (2006.01)

(52) U.S. Cl.
USPC ..... 34/607; 34/597

(58) Field of Classification Search
CPC ..... D06F 39/00; D06F 39/007; D06F 49/08; B65D 9/08
USPC ..... 34/597, 603, 604, 607, 68
See application file for complete search history.

(56) References Cited

U.S. PATENT DOCUMENTS

| | | | | |
|---|---|---|---|---|
| 3,597,851 | A * | 8/1971 | Arendt et al. | 34/60 |
| 4,207,683 | A | 6/1980 | Horton | |
| 4,747,751 | A | 5/1988 | Guillemot | |
| 5,207,764 | A | 5/1993 | Akabane et al. | |
| 5,228,211 | A * | 7/1993 | Stubbing | 34/443 |
| 5,588,313 | A * | 12/1996 | Hildebrand | 68/17 R |
| 7,882,647 | B2 * | 2/2011 | Ikemizu | 34/524 |
| 2005/0044782 | A1 | 3/2005 | Kuroda et al. | |
| 2005/0115120 | A1 * | 6/2005 | Cevik | 38/14 |
| 2006/0207121 | A1 * | 9/2006 | Lee | 34/89 |
| 2006/0277690 | A1 | 12/2006 | Pyo et al. | |
| 2007/0056328 | A1 | 3/2007 | Song | |
| 2008/0255637 | A1 | 10/2008 | Oishi | |
| 2009/0095750 | A1 * | 4/2009 | Vitan et al. | 220/23.83 |
| 2010/0083532 | A1 * | 4/2010 | Klug et al. | 34/597 |

FOREIGN PATENT DOCUMENTS

| | | | |
|---|---|---|---|
| DE | 3408136 | A1 * | 9/1985 |
| DE | 103 32 656 | A1 | 7/2003 |
| DE | 10332656 | A1 * | 7/2004 |
| DE | 10302864 | A1 * | 8/2004 |
| EP | 1 441 058 | A | 7/2004 |
| EP | 1 887 127 | A | 2/2008 |
| KR | 10-2005-0005498 | | 1/2005 |
| KR | 10-0594388 | | 6/2006 |
| KR | 100594388 | B * | 6/2006 |
| KR | 10-2006-0085537 | | 7/2006 |

* cited by examiner

*Primary Examiner* — Kenneth Rinehart
*Assistant Examiner* — John McCormack
(74) *Attorney, Agent, or Firm* — McKenna Long & Aldridge LLP

(57) ABSTRACT

A laundry machine, more particularly, a dryer is disclosed. A dryer includes a cabinet, a drum in which a drying object is held, a steam generation device to supply steam to the drum, a water supply device to supply water to the steam generation device in order to generate steam, an additive holding part in which an additive is held, and an additive supply device to supply the additive held in the additive holding part to the drum.

10 Claims, 13 Drawing Sheets

DRYER

CROSS REFERENCE TO RELATED APPLICATION

This application claims the benefit of the Patent Korean Application Nos. 10-2007-111378 filed on Nov. 2, 2007 and 10-2007-114754 filed on Nov. 12, 2007, which are hereby incorporated by reference as if fully set forth herein.

BACKGROUND OF THE DISCLOSURE

1. Field of the Disclosure

The present invention relates to a laundry machine. More particularly, the present invention relates to a drum type laundry dryer.

2. Discussion of the Related Art

Laundry machines are electric home appliances that typically include washers for washing laundry and dryers for drying laundry.

Recently, there have been more and more popularity for washers, especially, drum type washers that enhance washing efficiency and that economize in energy by adapting a steam generator to supply steam to laundry.

Also, demands for dryers that dry laundry artificially, not dry naturally, have been increasing due to improvement of human life quality.

However, conventional dryers are devices simply for drying laundry and there is a kind of a problem that users have to iron the dried laundry because of wrinkles generated on the laundry after drying. Accordingly, there is a necessary for additional functions rather than drying laundry.

Therefore, users prefer and ask dryers that can dry laundry that can be wearable right after drying and at this time the laundry should have pleasant smell to supply the user a pleasant and fresh feeling.

SUMMARY OF THE DISCLOSURE

Accordingly, the present invention is directed to a laundry machine, particularly, to a dryer.

In one aspect, a dryer is provided to remove bad smell of laundry and to add fragrance to laundry.

In another aspect, a dryer is provided to remove wrinkles and static electricity of laundry, thereby enhancing user convenience.

In a still further aspect, a dryer is provided for a user to use without an additional water supply facility such as a water tap. Here, in this case, safe water supplying is possible and expected accidents may be prevented in advance.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dryer includes a cabinet; a drum in which a drying object is held; a steam generation device to supply steam to the drum; a water supply device to supply water to the steam generation device in order to generate steam; an additive holding part in which an additive is held; and an additive supply device to supply the additive held in the additive holding part to the drum. Here, the steam supplied to the drum may be replaced with a fine moisture particle and hot air that are supplied to the drum together simultaneously. For that, an air supply device and a moisture supply device may be further provided in the dryer.

According to an embodiment, a dryer includes a drum in which a drying object is held; an air supply device to supply hot air or cool air to the drum; a steam generation device to supply steam to the drum; a water holding part in which water is held prior to be supplied to the steam generation device; an additive holding part in which an additive is held; and an additive supply device to supply the additive held in the additive holding part to the drum.

Here, the steam supply device includes a steam generator that generates steam; a pump that pumps the water held in the water holding part into the steam generator; a nozzle to supply the steam generated at the steam generator to the drum; and a pipe provided between the steam generator and the nozzle to form a path.

The additive supply device includes a pump that pumps the additive held in the additive holding part to generate a hydraulic pressure; a nozzle to supply the additive pumped by the pump to the drum; and a pipe provided between the pump and the nozzle to form a path.

The steam supply device includes a steam nozzle to spray steam into the drum. The additive supply device includes an additive nozzle to spray an additive into the drum.

Here, the steam nozzle and the additive nozzle may be configured to be separate, or to be a single nozzle. The steam nozzle and the additive nozzle are configured of a single nozzle having a single body. That is, a steam spray hole to spray steam and an additive spray hole to spray an additive are formed in the single nozzle. Alternatively, a spray hole is formed in the single nozzle to spray steam and an additive together.

Unlike a conventional dryer, the dryer according to the embodiment needs water and the water is not so much as water of a washer. The dryer may be installed in circumstances with bas water supply and drain facilities. As a result, the water holding part of the dryer according to the embodiment may be detachable from the dryer and a user fills water in the water holding part directly and the water is used in the dryer.

The additive holding part may be also detachable from the dryer like the water holding part. In this case, the water holding part and the additive holding part are provided in a drawer and the water holding part and the additive holding part are provided inside the drawer. Here, a drawer separately movable forward and rearward is formed at a front portion of the dryer. When supplying water or an additive, a user moves rearward and separates the drawer. After filling water, the user moves forward and detaches the drawer. Thus, the space occupied by the dryer may be reduced and an exterior appearance can be enhanced.

A dryer according to the embodiment includes a drum in which a drying object is held; an air supply device to supply hot air or cool air to the drum; a moisture supply device to supply a fine moisture particle to the drum; a water supply device to supply water for generating a fine moisture particle to the moisture supply device; a water supply device to supply water for generating steam to the steam supply device; an additive holding part in which an additive is held; and an additive supply device to supply the additive held in the additive holding part to the drum.

Here, the moisture supply device a pump that pumps the additive held in the additive holding part to generate a hydraulic pressure; a nozzle to supply the additive pumped by the pump to the drum; and a pipe provided between the pump and the nozzle to form a path.

When fine moisture particles are provided in the drum, hot air may be supplied to the drum through the air supply device in order to heighten a temperature of the fine moisture particle and to allow the fine moisture particle absorbed into the laundry smoothly and uniformly.

The water supply device includes a steam nozzle to spray steam into the drum and the additive supply device includes an additive nozzle to spray an additive into the drum.

Here, the steam nozzle and the additive nozzle may be configured to be separate, or to be a single nozzle. The steam nozzle and the additive nozzle are configured of a single nozzle having a single body. That is, a spray hole to spray fine moisture particles and an additive spray hole to spray an additive are formed in the single nozzle. Alternatively, a spray hole is formed in the single nozzle to spray fine moisture particles and an additive together.

A dryer according to the embodiment may include; a drum in which a drying object is held; an air supply device to supply hot air or cool air to the drum; a tank that holds water and an additive, the tank being detachable from the cabinet; and a moisture supply device that transforms the water and additive provided in the tank into fine moisture particles.

The water supply device includes a pump that pumps the water and additive held in the tank to generate a hydraulic pressure; a nozzle to supply fine moisture particles to the drum by transforming the pumped water and additive into fine moisture particles; and a pipe provided between the pump and the nozzle to form a path.

When the fine moisture particles are supplied to the drum, the hot air may be provided in the drum through the air supply device in order to heighten a temperature of the fine moisture particles and to allow the fine moisture particles absorbed into the laundry smoothly and uniformly.

In another aspect of the present invention, a dryer includes a drum in which a drying object is held; a steam generation device to supply steam to the drum; a water supply device connected with an external water supply source to supply water for steam generation to the steam generation device; a shutoff device that shuts off water overflowed from the steam generation device from being supplied to the drum; an additive holding part in which an additive is held; an additive supply device to supply the additive held in the additive holding part to the drum; and a controller that controls the steam generation device, the water supply device, the shutoff device and the additive supply device.

The steam supply device includes a steam generator that generates steam; and a steam path to supply the steam generated by the steam generation device to the drum. The shutoff device may be provided at the steam path and it may include a shutoff valve selectively opened and closed.

The shutoff device may be controlled according to a temperature of the steam generator. Specifically, when the temperature is over a preset valve, the shutoff valve is opened.

The additive supply device includes a pump that pumps the additive held in the additive holding part to generate a hydraulic pressure; and an additive path to supply the pumped additive to the drum.

The steam supply device includes a steam nozzle to spray steam into the drum and the additive supply device includes an additive nozzle to spray an additive into the drum. Here, the steam nozzle and the additive nozzle may be configured to be separate, or to be a single nozzle.

The steam nozzle and the additive nozzle are configured of a single nozzle having a single body. That is, a spray hole to spray fine moisture particles and an additive spray hole to spray an additive are formed in the single nozzle. Alternatively, a spray hole is formed in the single nozzle to spray fine moisture particles and an additive together.

Here, a drawer separately movable forward and rearward is formed at a front portion of the dryer. When supplying water or an additive, a user moves rearward and separates the drawer. After filling water, the user moves forward and detaches the drawer. Thus, the space occupied by the dryer may be reduced and an exterior appearance can be enhanced.

A dryer according to another embodiment of the present invention includes a drum in which a drying object is held; an air supply device to supply hot air or cool air to the drum; a moisture supply device to supply fine moisture particles to the drum; a water supply valve selectively opened and closed to selectively supply water to the moisture supply device, the water supply valve in communication with an external water source; a shutoff device provided in the moisture supply device to shut off substantially too much water from being supplied to the drum through the moisture supply device; an additive holding part in which an additive is held; an additive supply device to supply the additive held in the additive holding part to the drum; and a controller that controls the steam generation device, the water supply device, the shutoff device and the additive supply device.

Here, the shutoff device includes a shutoff valve selectively opened and closed.

The shutoff valve may be controlled to be closed if a preset time period passes after the controller generates a signal for opening the water supply valve. The shutoff valve may be controlled to be opened substantially at the same time. In addition, the shutoff valve may be controlled to be closed when an amount of water more than predetermined is supplied to the drum through the moisture supply device.

As a result, the shutoff device may prevent too much water from being supplied to the drum. Even in case of a failure of the water supply valve, too much water is prevented from being supplied to the drum.

It is preferable that the air supply device is controlled to supply hot air to the drum when the fine moisture particles are supplied to the drum.

The additive supply device includes an additive path to make the additive holding part in communication with the moisture supply device; and an additive valve that selectively opens and closes the additive path. Here, the additive supply device may further include a check valve provided at the additive path to prevent water from overflowing through the additive path.

The dryer according to the present invention supplies fine moisture particles or steam and an additive to the drum. In this case, the fine moisture particles or steam and the additive may be supplied to the laundry uniformly. When spraying the fine moisture particles or steam and the additive, the drum may be rotated. Especially, it is preferable that the laundry is tumbled to repeatedly lift and drop the laundry inside the drum.

Advantageous effects of the dryer will be described.

First, wrinkles or crumples on dried laundry may be prevented in advance according to the dryer.

Furthermore, the wrinkles on the dried laundry may be removed without additional ironing. Rather than drying the laundry, bad smell of the laundry may be removed and pleasant fragrance may be added to the laundry. As a result, user convenience is enhanced and the laundry taken out of the laundry right after the drying is wearable at the spot.

A still further, the dryer may be useable without additional water supply facilities.

A still further, too much water may be prevented from being supplied to the drum in advance.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Figure 1:
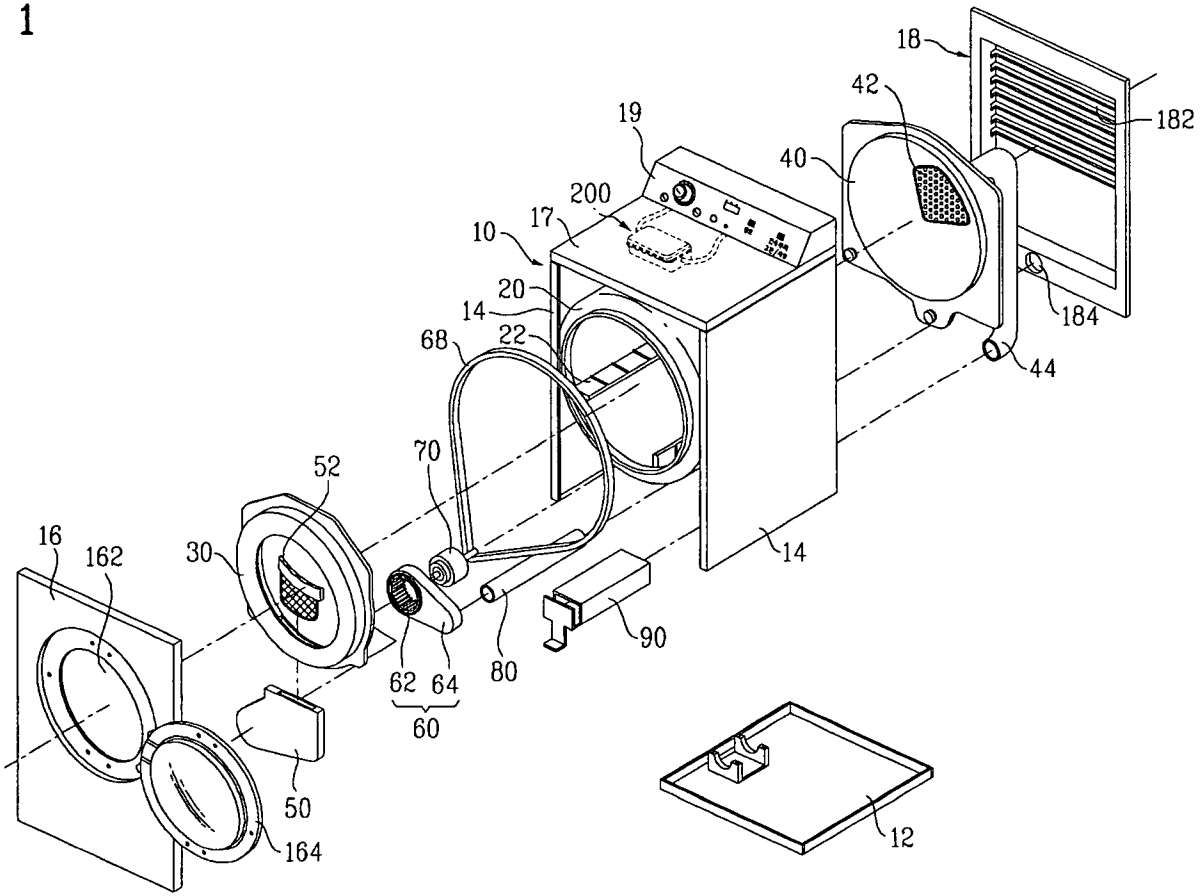
FIG. 1 is an exploded perspective view illustrating a dryer according to an exemplary embodiment.

Reference will now be made in detail to the specific embodiments of the present invention, examples of which are illustrated in the accompanying drawings. Wherever possible, the same reference numbers will be used throughout the drawings to refer to the same or like parts.

In reference to corresponding drawings, exemplary embodiments of the present invention will be explained.

In reference to FIGS. 1 and 2, an embodiment of a dryer will be explained. On convenience sake, this embodiment presents a top loading, electric and exhaustion type dryer and the present invention is not limited thereto.

There are provided in a cabinet 10 for defining an exterior appearance of a dryer a rotation drum 20, a motor 70 and a belt 68 both for driving the drum 20. In addition, an air supply device is provided in the cabinet 10 to supply hot air or cool air to the drum. Here, drying objects, that is, laundry may be put in the drum 20.

The air supply device is provided in a predetermined portion of the cabinet 10 and it includes a hot air heater 90, a hot air supply duct 44, an exhaustion duct 80, and a blower unit 60. The hot air heater 90 generates high temperature air (hereinafter, hot air) by heating air. The hot air supply duct 44 is configured to supply the hot air generated at the hot air heater 90 to the drum 20. The exhaustion duct 80 is configured to exhaust humid air heat exchanged with the laundry in the drum 20. The blower unit 60 is configured to suck the humid air. Here, a condensation duct and a condenser may be provided in a condensation dryer to condense water from the humid air heat exchanged with the laundry.

A steam generation device is provided in the cabinet 10. Here, the steam generation device generates steam and supplies the steam to an inside the drum 20. Such the steam generation device may include a steam generator 200 that generates high temperature steam by heating water.

This embodiment presents an indirect drive type in that the drum 20 is rotated by using the motor 70 and the belt 68 and the present invention is not limited thereto. For example, a direct drive type may be applicable in that a motor is directly connected with a rear surface of the drum 20 to directly rotate the drum 20.

Each above configuration will be explained in detail.

The cabinet 10 defines an exterior appearance of the dryer and it includes a base 12, a pair of side covers 14, a front cover 16, a rear cover 18 and a top cover 17. The base 12 forms a bottom of the dryer and the side covers 14 are perpendicular to the base 12, respectively. The front cover 16 and the rear cover 18 are coupled to a front and a rear of the side covers, respectively. The top cover 17 is provided at a top of the side covers 14. A control panel 19 is commonly positioned on the top cover 17 or the front cover 16 and the control panel 19 includes various operational switches. A door 164 is coupled to the front cover 16. An inlet 182 and an outlet 184 are provided at the rear cover 18. External air is drawn through the inlet 182 and the air inside the drum 20 is exhausted through the outlet 184 lastly.

An inner space of the drum 20 is functioned as a drying chamber in which drying is performed and a lift 22 is provided inside the drum 20.

A front supporter 30 and a rear supporter 40 are installed between the drum 20 and the cabinet 10, specifically, between the front cover 16 and the rear cover 18. The drum 20 is rotatably installed between the front cover 30 and the rear supporter 40. A sealing member (not shown) is provided between the front supporter 30 and the drum 20 and between the rear supporter 40 and the drum 20 to prevent water leakage. That is, front supporter 30 and the rear supporter 40 close a front surface and a rear surface of the drum 20 to form the drying chamber as well as to support a front and a rear of the drum 20.

An opening is formed at the front supporter 30 to make the drum 20 in communication with an outside of the dryer and the opening is selectively opened and closed by the door 164. Also, a lint duct 50 is connected with the front supporter 30 and the air inside the drum 20 is exhausted through the lint duct 50. A lint filter 52 is installed at the lint duct 50. portion of the blower unit 60 is connected with the lint duct 50 and the other opposite portion of the blower 60 is connected with the exhaustion duct 80 and the exhaustion duct 80 is in communication with the outlet 184 provided at the rear cover 18. As a result, once the blower unit 60 is operated, the air inside the drum 20 passes the lint duct 50, the exhaustion duct 80 and the outlet 184 in order and it is exhausted outside. At this time, foreign substances including lint are filtered by the lint filter 52. Commonly, the blower unit 60 includes a blower 62 and a blower housing 64. The blower 62 is typically connected with the motor 70 for driving the drum 20.

An open portion 42 configured of plural through holes is formed at the rear supporter 40 and the hot air supply duct 44 is connected with the open portion 42. The hot air supply duct 44 is in communication with the drum 20 to be a path through which hot air is supplied to the drum 20. As a result, the hot air heater 90 is installed at a predetermined portion of the hot air supply duct 44.

Figure 3:
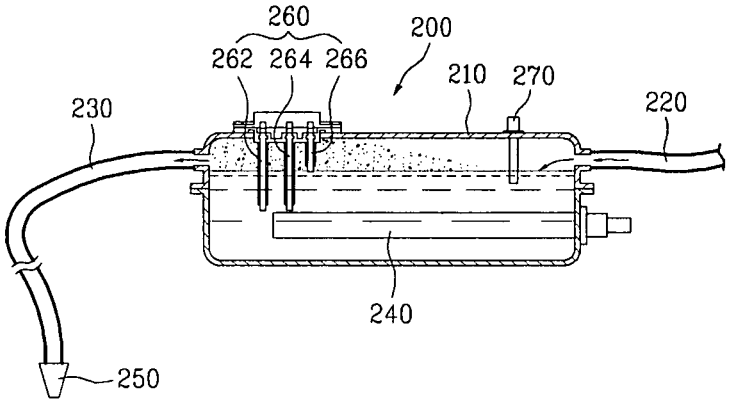
FIG. 3 is a sectional view of a steam generator shown in FIG. 1.

Next, in reference to FIG. 3, a specific configuration of the steam generator 200 will be explained.

The steam generator 200 includes a water tank 210, a heater 240, a water level sensor 260 and a temperature sensor 270. Water is put in the water tank 210 and the heater 240 is mounted in the water tank 210. A water level of the water tank 210 is sensed by the water level sensor 260 and a water temperature of the water tank 210 is sensed by the temperature sensor 270.

The water level sensor 260 typically includes a common electrode 262, a low level electrode 264 and a high level electrode 266. A high water level is sensed based on whether an electric current is applied between the common electrode 262 and the high water level electrode 266, and a low water level is sensed based on whether an electrode current is applied between the common electrode 262 and the low water level electrode 264.

A water supply path 220 is connected with a predetermined portion of the steam generator 200 to supply water and the water supply path 220 is extended from a water holding part which will be described later. A steam path 230 is connected with the other opposite portion of the steam generator 200 to exhaust steam. It is preferable that a nozzle 250 is installed at an end of the steam path 230 to improve efficiency of steam spray.

Thus, steam is supplied to the drum through the steam generation device including the above steam generator 200.

However, such that steam generator may be configured as another type. Specifically, instead of heating the water held in the water tank 210, water flowing in a piped shaped housing (not shown) is heated to generate steam. The former may be called as tank type steam generator and the latter may be called as pipe type steam generator.

In the pipe type steam generator, water is heated quickly and steam is generated. As a result, the time taken to generate steam may be shortened, compared with the time taken in the tank type steam generator. However, there might be a problem that high temperature water may be supplied to the drum in the pipe type steam generator. While, steam may be supplied to the drum safely and securely in the tank type steam generator.

Here, there are advantageous effects of using steam in the dryer.

Dryers commonly dry laundry by using hot air. At this time, as drying the laundry, wrinkles may be generated on the laundry. As a result, additional ironing is necessary after drying. To solve such the problem, steam is supplied as drying the laundry and wrinkles may be generated less or removed. This is because steam is supplied to crumpled portions of the laundry and that moisture of the laundry is dried by hot air. It is preferable that the time for supply such steam is after the drying is performed in a predetermined degree of dryness.

In the meantime, steam is very fine water particles, specifically, thousands of microns of water particles. Such the steam may supply moisture and a high temperature to the laundry to remove smelly elements. As a result, bad smell of laundry may be also removed efficiently by drying the laundry using the steam.

It is possible to supply a predetermined amount of moisture to the laundry by using steam prior to completion of drying. It is also possible to supply a predetermined amount of moisture to the laundry by using steam after the completion of drying. Since the moisture is supplied to the laundry uniformly by the steam, an unpleasant feeling which a user might feel when taking out the laundry from the drum because of static electricity will be prevented in advance.

Here, steam is a medium for supplying moisture and a high temperature to the laundry. As mentioned above, steam is fine water particles with a high temperature and thus the steam may penetrate through the laundry. As a result, the moisture may be absorbed in the whole area of the laundry uniformly and it is prevented that the moisture is absorbed in a specific area of the laundry too much.

Figure 4:
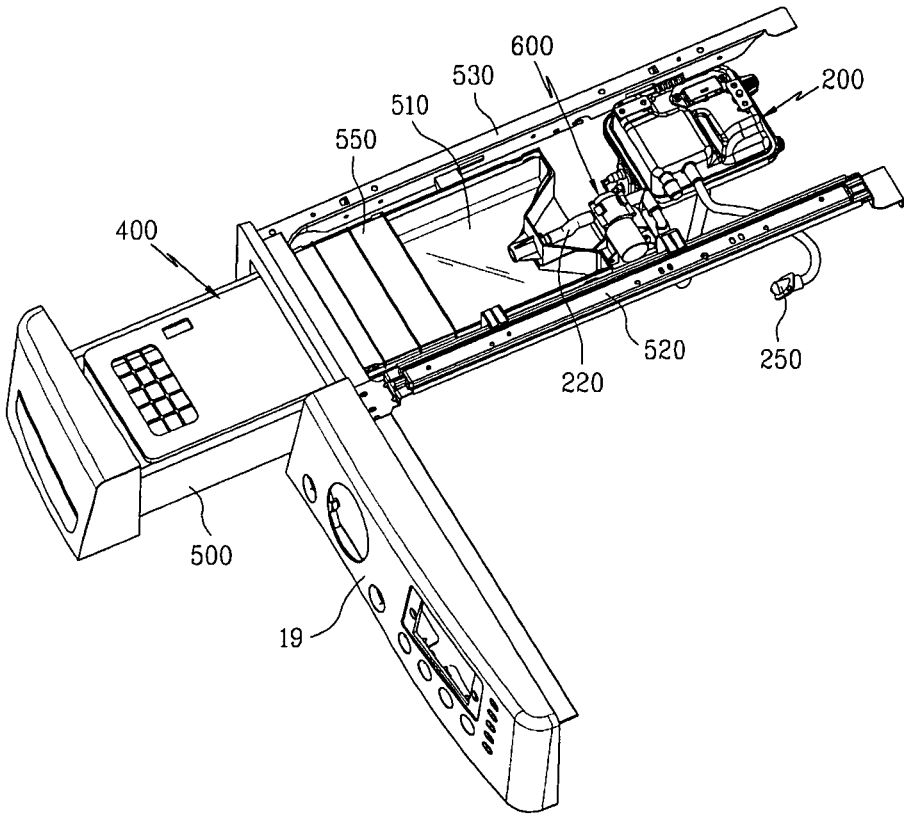
FIG. 4 is a diagram illustrating a mounting structure of the steam generator.

FIG. 4 shows an embodiment that a user directly supplies water to the steam generator 200 while the steam generator 200 is not connected with an external water supply source. This embodiment allows a dryer to be conveniently used even in circumstances with bad water supply and drain facilities.

Next, the steam generator 200 and a water supply structure to the steam generator 200 will be explained.

There may be provided a drawer type container (hereinafter, a drawer) 500 that is separately movable forward and rearward in a predetermined portion of the dryer and it is preferable that a tank 400 is mounted at the drawer 500. Here, the tank is a water holding part in which water is held and the water held in the water holding part is supplied to the steam generator 200. The tank may be an additive holding part which will be described later and the both of the water holding part and the additive holding part may be adapted.

It is preferable that the tank 400 is mounted in the drawer 500 and that the drawer 500 is separately moved forward and rearward to be indirectly mountable to and separable from the water supply path 220, instead of making the tank 400 directly connected with the water supply path 220. This is because a water amount used in a dryer is relatively less than a water amount used in a washer and because a dryer might be used in circumstances having bad water supply facilities.

The drawer 500 may be provided in a front portion of the dryer, specifically, in a front surface of the cabinet of the dryer. Especially, for example, it is preferable that the drawer 500 is provided at the control panel 19.

More specifically, a supporter 520 is installed in rear of the control panel. That is, the supporter 520 is substantially parallel to a top frame 530. It is preferable that a drawer guide 510 is installed at the supporter 520 and the top frame 530 to guide and support the drawer 500. It is more preferable that a top guide 550 is provided on the drawer guide 510.

Here, an upper portion and a predetermined side portion (toward a front surface of the dryer) of the drawer guide 520 are open. The drawer 500 is moving forward and rearward through the open portions.

In this embodiment, the tank 400 for supplying water to the steam generator 200 may be detachable.

It is very convenient of a user to separate the detachable tank 400 and to put water in the tank 400 before connecting the tank 400 filled with water with the water supply path 220.

A pump 600 may be provided between the tank 400 and the steam generator 200. The pump 600 may be rotatable in a clockwise and counter-clockwise direction. The pump 600 can make water supplied to the steam generator 200 or remaining water of the steam generator drained outside.

Thus, the steam generation device according to the present invention include the steam generator 200 for generating steam, the pump 600 for pumping the water of the tank 400 so that the water is supplied to the steam generator 200, and a nozzle 250 for supply the steam to the drum.

Here, the water supply path 220 is provided between the tank 400 and the steam generator 200 and the steam path 230 is provided between the steam generator 200 and the nozzle 250. The paths 220 and 230 may be configured to be pipe shaped.

The dryer according to the embodiment may further include an additive supply device for supplying an additive to the drum.

Here, the additive may be configured of a fabric softener or a pleasant fragrance. Such that additive is supplied to the laundry to serve to remove friction between the inside of the drum and the laundry and between the laundries, which prevents the laundry damage. In addition, the pleasant fragrance is supplied to the laundry. When the drying is complete, a user may be given the laundry, feeling pleasant and fresh. Such the fragrance is also supplied to the laundry and a texture of the fabric is rich for a user to feel fresh.

According to the present invention, bad smell is removed by using steam and the bad smell is removed more efficiently by using activation between steam and hot air. As a result, the pleasant fragrance is supplied together with removing bas smell or the fragrance is supplied to the laundry after removing bad smell, which leads to improved fragrance supply effect.

Next, in reference to FIGS. 5 and 6, a configuration to supply the additive to the drum will be explained.

Figure 6:
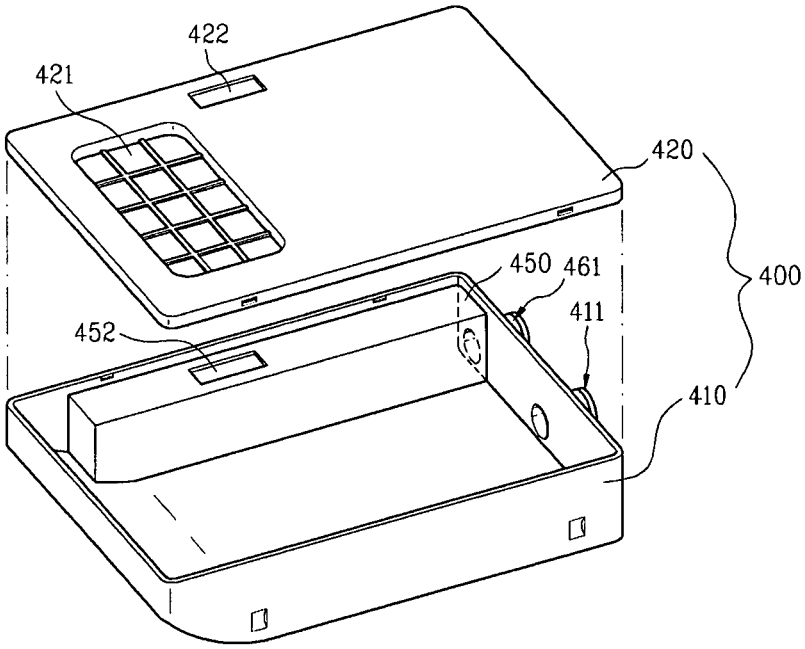
FIG. 6 is a perspective view illustrating an example of a water holding part and an example of an additive holding part of the dryer according to the embodiment.

As shown in FIG. 6, an additive holding part 450 in which the additive is held may be provided in the drawer 500 described above. The additive holding part may be configured of a tank shape detachable from the drawer 500. As a result, the additive holding part may be detachable from the dryer.

Here, it is preferable that the additive holding part 450 and the water holding part are separate ones to prevent the additive from being supplied to the steam generator 200. Such the additive includes a surfactant to make fragrance elements dissolved in water smoothly. When the additive is heated, too much foam might be generated because of the surfactant.

Here, much amount of additive is not needed and the additive holding part 450 is provided in a predetermined space the tank 400 separately from the space for the water. That is, a user may detach the water 400 from the dryer together with the additive holding part simultaneously and at this time the additive is held, not mixed with the water.

As shown in FIG. 6, the tank 400 may be configured of the additive holding part 450 in which various kinds of additives such as static electricity softener, fragrance and the like are held.

The tank 400 includes a holding part 410, a cover 420. Water is stored in the holding part 410 and the cover 420 covers the holding part 410. As shown in the drawing, the additive holding part 450 may be provided in the water holding part 410 auxiliary.

A water drain hole 411 connected with the water supply path 220 is formed at the holding part 410 and water is drained through the water drain hole 411. A water introduction hole 421 and an additive introduction hole 422 are formed at the cover 420. The water and the additive are introduced in the holding part 410 and the additive holding part 422 provided in the holding part 410, not mixedly, without separating the cover 420 from the holding part 410. An additive introduction hole 452 corresponding to the additive introduction hole 422 of the cover 420 is formed at the additive holding part 450.

In addition, an additive drain hole 461 is formed at the additive holding part 450 and the additive is drained through the additive drain hole 461.

Figure 5:
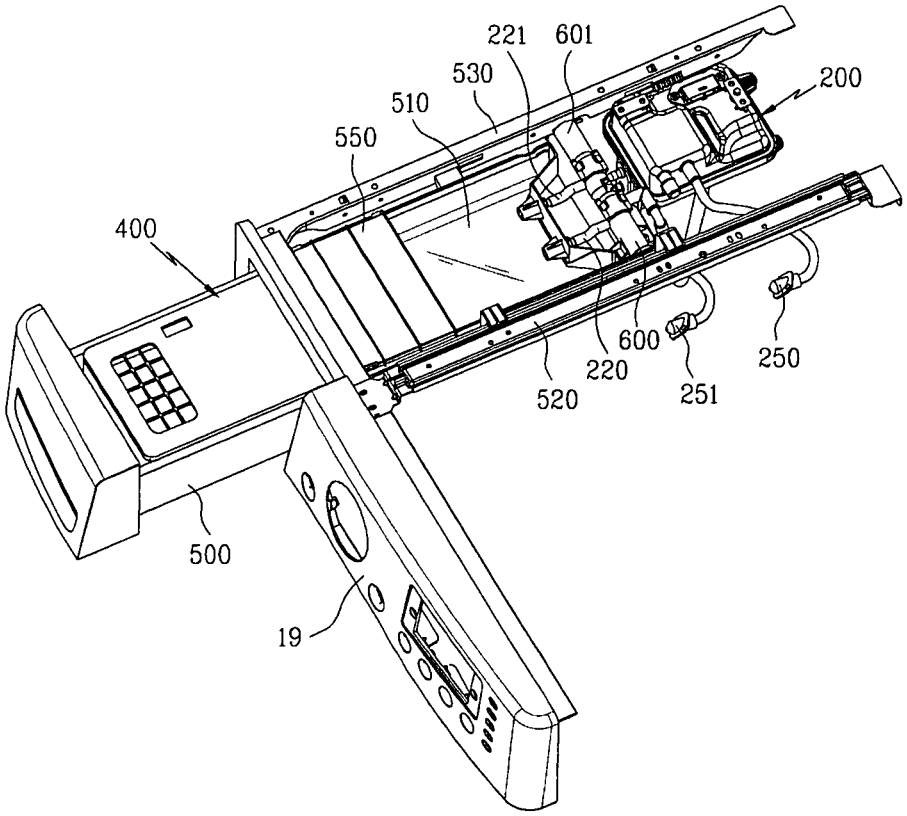
FIG. 5 is a diagram illustrating a mounting structure of the steam generator and a water supply device according to the embodiment.

As shown in FIG. 5, the additive introduced in the additive holding part 450 is supplied to the drum, not mixed with the water introduced in the holding part 410. That is, the water of the holding part 410 is supplied to the steam generator 200 through the pump 600 and the additive of the additive holding part 450 is supplied to the drum through a pump 601 and a nozzle 251. For that, two pumps 600 and 601 may be provided and also two nozzles 250 and 251 may be provided.

Thus, the additive supply device according to the present invention includes the pump 601 for pumping the additive held in the additive holding part 450 in order to generate a hydraulic pressure and the nozzle 601 for supplying the pumped additive to the drum. The additive supply device further may include a path 221 provided between the pump 601 and the nozzle 251.

Next, a process of supplying the additive to the drum will be described.

First, the process of supplying steam to the drum will be described. The water held in the holding part 410 is supplied to the steam generator 200 through the water supply path 220. At this time, the pump 600 generates the hydraulic pressure to draw the water into the steam generator 200. The water inside the steam generator 200 is heated to be transformed into steam and the steam is sprayed into the drum through the steam path 230 and the steam nozzle 250.

In comparison, the process of supplying the additive to the drum will be described. The additive held in the additive holding part 450 is sprayed into the drum through the additive path 221 that is a separate one from the water supply path 220 and the additive nozzle 351 that is a separate one from the steam nozzle 250. As a result, the additive may be sprayed into the drum, not mixed with the steam.

Here, the steam nozzle 250 and the additive nozzle 251 may be configured to be separate or to be a single nozzle (not shown). In case of the single nozzle, a steam spray hole and an additive spray hole are formed in the single nozzle, respectively. That is, such the spray holes may be in communication with the steam path and the additive path, respectively. If then, it is convenient to produce the single nozzle because steam and additive are sprayed by using the single nozzle. For example, if an opening (not shown) for the single nozzle is formed at the rear supporter 40, the production process may be simple and steam and additive may be sprayed at an optimal position.

Although not shown in the drawings, the pump 601 and the nozzle 251 for supplying the additive may be omitted. That is, the path 221 for supplying the additive may be connected with the steam path 230. In other words, it is possible to supply the additive to the drum by using the pressure for supplying steam.

When steam is supplied through the steam path 230, a sound pressure is generated and the additive is sucked through the path 221 for supply the additive. As a result, the additive is drawn in the steam path 221 and the steam and the additive are sprayed into the drum through the single nozzle 250. However, at this time the steam might be supplied to the additive holding part 450 through the path 221. Thus, it is preferable that a check valve (not shown) is provided at the additive path to prevent the steam from being supplied to the additive holding part 450. In addition, a valve (not shown) selectively closable may be provided at the additive path, because there is also necessity for selective supplying of the additive. If the valve is closed, only steam is sprayed into the drum.

As a result, additional nozzle and pump for the additive supply may not necessary because of the above configuration. However, in this case, the additive may not be supplied to the drum separately, not mixed with steam.

Accordingly, the dryer according to the present invention may have the additive and the steam supplied to the drum separately, or the additive to be supplied together when the steam is supplied.

The configuration of the single tank 400 having the water holding part 410 and the additive holding part 450 is described above. However, the water holding part 410 and the additive holding part 450 may be separate and detachable from the dryer. Also, the water holding part 410 and the additive holding part 450 may not be necessarily positioned at the same portion. For example, if the water holding part 410 is positioned at the drawer 500 as mentioned above, the additive holding part 450 may be positioned at the upper surface or a lower portion of the front surface of the dryer.

The above embodiment presents that the steam and the additive are provided inside the drum and the present invention is not limited thereto.

For example, the configuration of the steam generator 200 for generating steam in the above embodiment may be omitted. In this case, fine moisture particles instead of steam may be supplied.

Specifically, if the water held in the water holding part 410 is pumped by the pump 600, a hydraulic pressure is generated and the water having the hydraulic pressure passes the nozzle 250 to be converted into fine moisture particles which will be supplied to the drum. Here, the nozzle 250 for supplying the fine moisture particles may have a different shape from the nozzle described above.

The fine moisture particles may be generated by spraying normal temperature water and the temperature of the fine moisture particles is not so high, compared with the temperature of steam. The size of particle may be thousands of microns. As a result, there may be a concern that the fine moisture particles may be supplied to specific areas of the laundry, not the whole area, compared with the steam. In addition, the fine moisture particles may not penetrate through the laundry as deep as the steam does.

To relieve the concern, the fine moisture particles have to be heated. That is, such the fine moisture particles may be similar to steam as much as possible.

In the dryer is provided the air supply device to supply hot air or cool air to the drum as mentioned above. It is preferable that the air supply device is controlled to operate in order to supply the hot air to the drum when the fine moisture particles are supplied to the drum. Thus, the fine moisture particles are heated and vapors are formed partially. As a result, the size of the fine moisture particle is getting small with a high temperature such that the moisture may penetrate through the laundry uniformly and deep. A position of the nozzle for spraying the fine moisture particles may be adjacent to a position of the open portion 42 through which the hot air is drawn into the drum.

That is, the nozzle 250 for spraying the fine moisture particle into the drum is provided at the rear supporter 40, adjacent to the open portion 42.

Alternatively, the nozzle 250 may be at the hot air supply duct 44 and the fine moisture particles may be heated in the hot air supply duct 44 to be supplied to the drum through the open portion 42 together with the hot air.

In the meantime, the additive may be supplied to the drum, separate from or together with the steam or fine moisture particles in the above embodiments and the present invention is not limited thereto.

As shown in FIG. 4, the water and the additive may be held in the tank 400 together. The water and the additive may be mixedly supplied to the drum through the pump 600 and the nozzle 250 together. Here, the steam generator 400 shown in FIG. 4 is omitted. If the water mixed with the additive is heated at the steam generator 400, foam may be generated because of a surfactant.

Such the water and additive may be supplied to the laundry inside the drum in a fine water droplet shape to perform functions such as removing wrinkles and static electricity, smoothing fabric and adding pleasant fragrance.

In addition, it is convenient of a user to fill the single tank 400 with the water and the additive.

Here, an auxiliary additive holding part 450 may be provided additionally in the tank 400 so that a user may put an appropriate amount of additive in the additive holding part 450.

Figure 7:
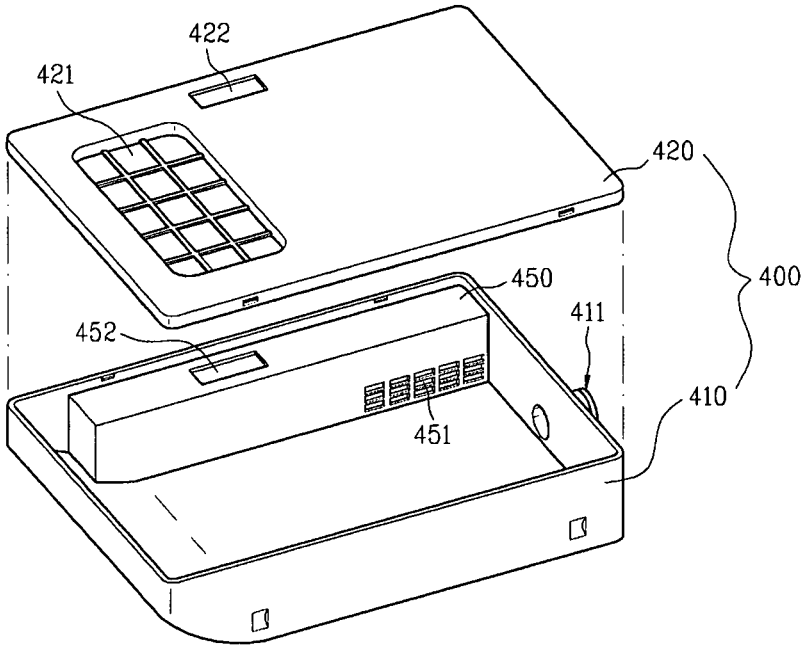
FIG. 7 is a perspective view illustrating another example of the water holding part and another example of the additive holding part.

As shown in FIG. 7, the additive holding part 450 is in communication with the water holding part 410 through a wayout hole portion 451. Here, the wayout hole portion 451 may be selectively opened and closed by the controller 10. Opening and closing the wayout hole portion 451 prevents a too much amount of the additive from being mixed with the water, such that the additive may be selectively supplied to the drum together with the fine moisture particle.

A membrane film (not shown) may be provided at the wayout hole portion 451. That is, the appropriate amount of the additive is drawn into the water holding part 410 by using an osmotic pressure between the additive of the additive holding part 450 and the water of the water holding part 410, only to be supplied to the drum.

Hence, no matter what shape, the additive is mixed with the water in the water holding part 410 and it is supplied to the drum through the pump 600 and the nozzle 250.

Since the temperature of the additive and the water is not relatively high even in this example, the additive and the water may be supplied to the drum in a fine moisture particle shape as mentioned above and they may be supplied together with the hot air.

Next, a dryer according to another embodiment of the present invention in reference to corresponding drawings will be described.

In this embodiment, like in the above embodiment, steam and an additive may be supplied to a drum, or fine moisture particles and an additive together with hot air may be supplied to the drum. Thus, identical part to the above embodiment will be omitted.

In this embodiment, water for generating steam or fine moisture particles is supplied by an external water supply source, unlike the above embodiment. That is, instead of the water supplied through the water holding part by a user, water is supplied through a water tap positioned outside by the controller if necessary.

Next, in reference to the corresponding drawings, this embodiment will be explained.

Figure 8:
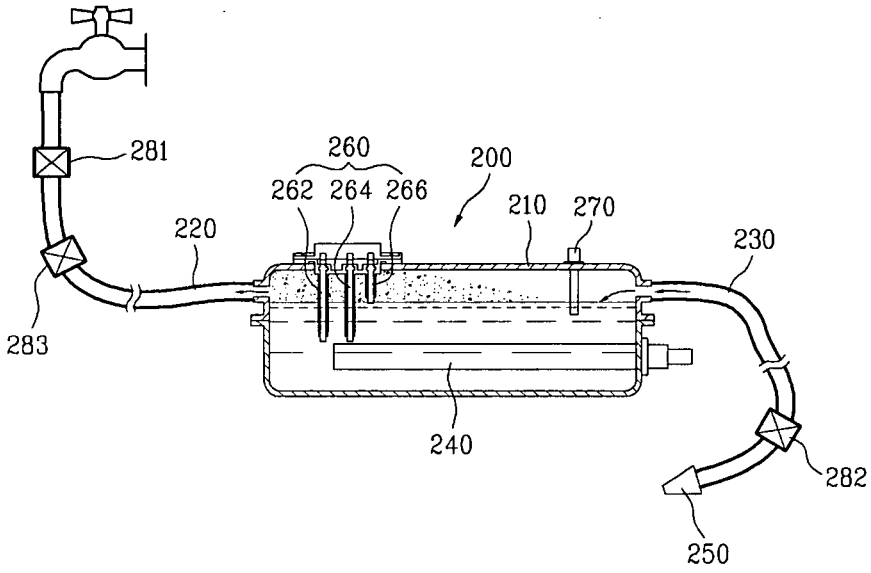
FIG. 8 is a sectional view illustrating a steam generator of a dryer according to another embodiment.

First of all, in reference to FIG. 8, the specific structure of a steam generator 200 will be explained.

The steam generator 200 includes a water tank 210, a heater 240, a water level sensor 260 and a temperature sensor 270. Water is put in the water tank 210 and the heater 240 is mounted in the water tank 210. A water level of the water tank 210 is sensed and a water temperature of the water tank 210 is sensed.

The water level sensor 260 typically includes a common electrode 262, a low level electrode 264 and a high level electrode 266. A high water level is sensed based on whether an electric current is applied between the common electrode 262 and the high water level electrode 266, and a low water level is sensed based on whether an electrode current is applied between the common electrode 262 and the low water level electrode 264.

A water supply path 220 is connected with a predetermined portion of the steam generator 200 and the water supply path 220 is connected with an external water supply source such as a water tap. The water is supplied to the steam generator through the water supply path 220. A steam path 230 is connected with the other opposite portion of the steam generator 200. A nozzle 250 may be installed at an end of the steam path 230 to improve the efficiency of steam spray. Connection portions between the steam generator 200 and the water path 220 and between the steam generator 200 and the steam path 230 may be changed in various ways as necessary. The water supply path and the steam path may be called variously according to which fluidal material flows, and every path may be defined as a pipe.

Here, the end of the steam path 230 or the nozzle 250, that is, a steam outlet is positioned in a predetermined portion of the drum 20 to spray steam into the drum 20. The nozzle 250 may be installed at a front portion or a rear portion of the drum, or it may be installed at the rear supporter 40.

A water supply valve 281 may be installed at the water supply path 220. That is, the controller selectively opens and closes the water supply valve as necessary. When water is needed in the dryer, the controller opens the water supply valve 281 and when water is not needed in the dryer, the controller closes the water supply valve 281. Here, the opening and closing of the water supply valve may be in relation with a water level sensed by the water level sensor 260. That is, in case of a lower level, the water supply valve 281 is opened. In case of a high level, the water supply valve 281 is closed.

Furthermore, a shutoff device may be provided at the steam path 230. Such that shutoff device may be provided at the steam generator 200. The steam generator and the steam path 230 may be included in a steam supply device and the nozzle 250 may be included in the steam supply device. Thus, the shutoff device may be included in the steam supply device.

The shutoff device prevents overflowed water of the steam supply device from being supplied to the drum. Here, the overflowed water may not mean that a small amount of water flows into the drum from the steam generator. This because steam is condensed and the condensed water at the steam path 230 may be discharged into the drum 20, although not preferable. Thus, the overflowed water may mean that water is continuously supplied to the drum from the steam supply device, that is, that water is supplied continuously under an uncontrollable condition.

The shutoff device may include a shutoff valve 282 provided at the steam path 230.

The overflowed water may be generated in flowing conditions. For example, when the water supply valve 281 is out of order, water may flow into the drum through the water supply valve 281 and the steam generator 200. Also, when the water level sensor 260 is out of order and it fails to sense a high level in the steam generator 200, water may flow into the drum continuously through the water supply valve 281 and the steam generator 200.

The steam supply device is configured to supply steam to the drum so that a small amount of moisture and a high temperature may be supplied to the laundry. That is, steam for drying the laundry is used in the dryer as necessary. As a result, dryers may not include a tub for storing water, a water drain device for draining the water of the tub and a water drain hose, unlike washers. If a large amount of water is supplied to the drum of the dryer, water flows into a sub-electric assembly of the dryer only to cause an electric leakage. In addition, the water overflowed from the drum flows outside the dryer to cause environmental pollution. The dryer for drying laundry might wet the laundry.

However, the shutoff device, especially, the shutoff valve 282 mentioned above may prevent such the problems.

The shutoff valve 282 may be controlled based on temperatures of the steam generator 200. If water is heated and steam is generated, the water is high temperature water. However, if water is supplied to the steam generator continuously, the temperature of water may be high even in heating the water. if the temperature of the steam generator is over a predetermined value, for example, at 100° C. and the shutoff valve 282 is controlled to be opened, the water is prevented from being supplied to the drum.

The shutoff valve 282 may be controlled in communication with the water supply valve 281. For example, the shutoff valve 282 may be closed in a preset time after an open signal of the water supply valve 281 is generated by the controller. Here, the preset time may be predetermined based on a time taken for water to be supplied to and heated in the steam generator 200 and a time taken for the steam to be supplied to the drum. As a result, even in a failure of the water supply valve 281, the water may be prevented from being supplied to the drum after the preset time.

The shutoff valve 282 and the water supply valve 281 may be controlled to be substantially opened at the same time. If the shutoff valve 282 is closed in supplying water through the water supply valve 281, a path from the water supply path 220 to the shutoff valve 282 is closed airtight such that water may not be supplied to the steam generator 200 smoothly.

The shutoff valve 282 may be controlled to be closed when an amount of water more than a predetermined amount is supplied to the drum through the steam generator. Except those conditions, the shutoff valve 282 may be maintained open.

Here, the preset amount of the water may be sensed by a water amount sensor 283. The water amount sensor may be provided at the water supply path 220. The water amount sensor may be configured as an impeller type sensor that is well known. That is, the amount of supplied water through the water supply path is sensed by using the rotation number of an impeller. If it is sensed that a too much amount of water is supplied to the steam generator by the water amount sensor, the shutoff valve 282 may be closed.

Next, in reference to FIGS. 9 and 10, a structure of supplying an additive to the drum will be explained.

Figure 9:
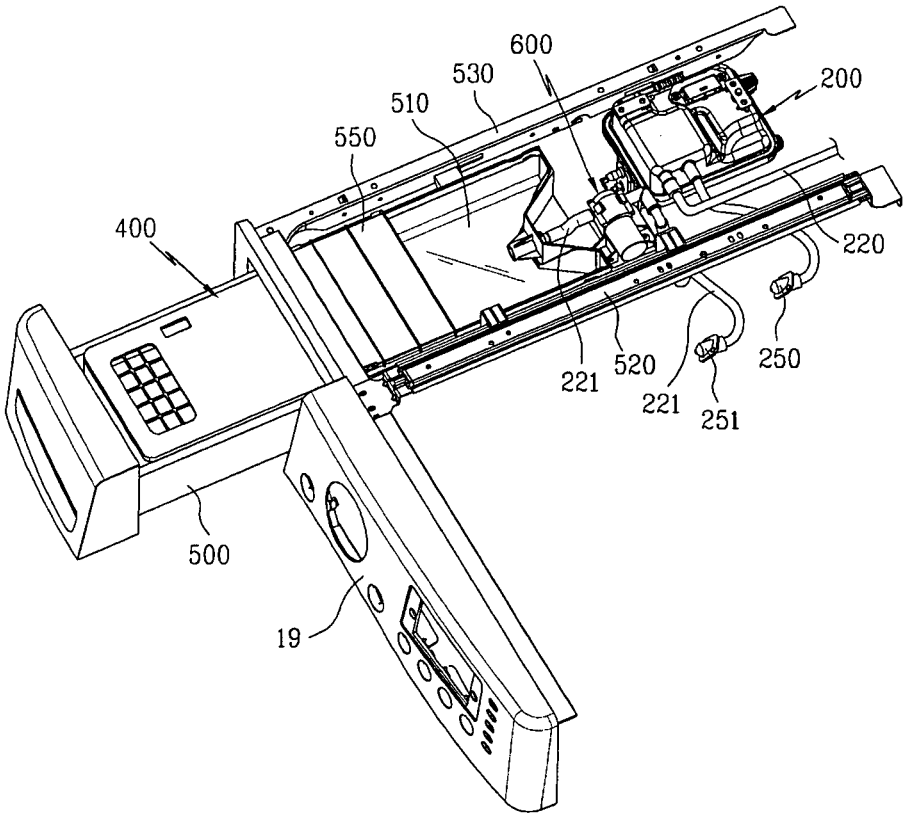
FIG. 9 is a diagram illustrating a mounting structure of the steam generator and an additive supply device of the dryer according to another embodiment.

FIG. 9 shows that the steam generator 200 is connected with an external water supply source through the water supply path 220 and it shows the structure for supplying the additive to the drum.

In this embodiment, a drawer type container (hereinafter, a drawer) 500 separately moving forward and rearward is installed in a predetermined portion of the dryer. A tank 400 is mounted in the drawer 500. Here, the tank 400 is an additive holding part and the additive held in the additive holding part is supplied to the drum.

The tank 400 may be mounted in the drawer 500 and the drawer 500 moves forward and rearward to mount to indirectly separate the drawer 500 to and from the additive path 220, rather than the tank 400 connected with the additive path 221 directly. This is because a user may introduce the additive smoothly.

The drawer 500 may be provided at a front surface of the dryer, that is, the cabinet. Especially, the drawer 500 may be provided at the control panel 19.

More specifically, a supporter 520 is installed in rear of the control panel. That is, the supporter 520 is substantially parallel to a top frame 530. It is preferable that a drawer guide 510 is installed at the supporter 520 and the top frame 530 to guide and support the drawer 500. It is more preferable that a top guide 550 is provided on the drawer guide 510.

Here, an upper portion and a predetermined side portion (toward a front surface of the dryer) of the drawer guide 520 are open. The drawer 500 is moving forward and rearward through the open portions.

In this embodiment, the tank 400 for supplying water to the steam generator 200 may be detachable. Here, the tank 400 may be configured as a cartridge that can be replaced by a user and thus the user is relieved of inconvenience of directly putting the additive every time. That is, the tank having the additive is configured to be a replaceable cartridge type. If purchasing such the cartridge and mounting it to the dryer, a user can use the dryer conveniently.

Such the cartridge may be changed variously according to a kind of fragrance. If changing only a cartridge, various demands of customers may be satisfied.

A pump 600 may be provided at the additive path 221 and a hydraulic pressure is generated by the pump 600. The additive may be sprayed into the drum through the nozzle 251.

Figure 10:
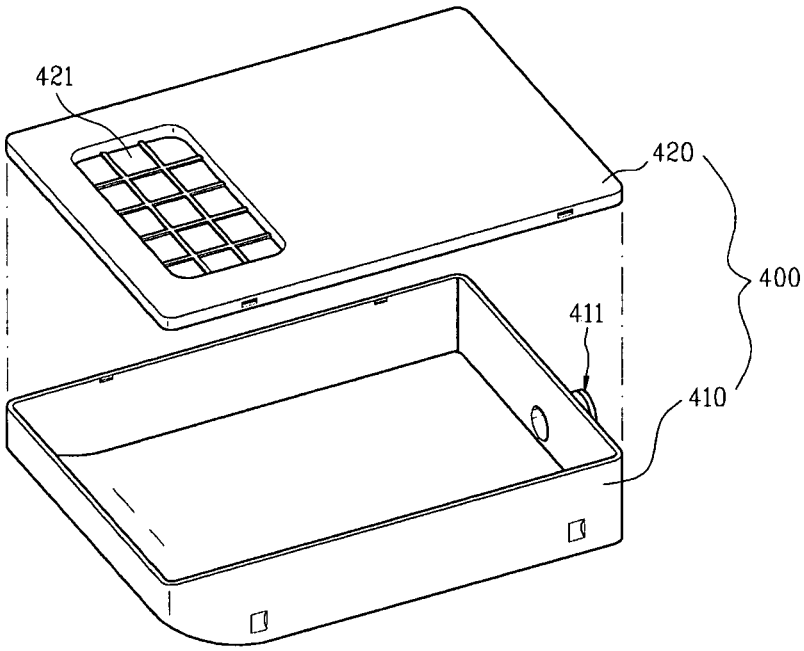
FIG. 10 is a perspective view illustrating an example of the additive holding part of the dryer according to another embodiment.

FIG. 10 illustrates the tank 400 and as shown in FIG. 10 various kinds of additives such as an anti-static electricity agent, a fragrance and variations of them are held in the tank 400.

The tank 400 includes an additive holding part 410 and a cover part 420. The additive is held in the additive holding part 410 and the cover part 420 covers the additive holding part 410.

A water drain hole 411 as a path to make water drained through which water is discharged is formed at the holding part 410 and the water drain hole 411 is connected with the additive path 211. A water introduction hole 421 and an additive introduction hole 422 are formed at the cover part 420. As a result, the water and additive may be introduced through the water introduction hole 421 and the additive introduction hole 422, without separating the cover part 420 from the holding part 410.

As shown in FIG. 10, the additive introduced in the tank 400 is supplied to the drum through the pump 600 and the nozzle 251. For that, the nozzle 251 may be provided as a separate one from the nozzle 250 for spraying steam.

The additive supply device according to the present invention includes the pump 500 that pumps the additive held in the additive holding part 410 to generate a hydraulic pressure, and the nozzle 251 for supplying the pumped additive to the drum. Of course, the additive supply device includes the path 221 between the pump 600 and the nozzle 251.

Next, a process of supplying the steam and additive to the drum will be explained. Water for steam generation is supplied to the steam generator 200 through the water supply valve 281 and the water supply path 220. the water inside the steam generator First, the process of supplying steam to the drum will be described. The water held in the holding part 410 is supplied to the steam generator 200 through the water supply valve 281 and the water supply path 220. The water inside the steam generator 200 is heated to be transformed into steam and the steam is sprayed into the drum through the steam path 230 and the steam nozzle 250. Here, the shutoff valve 282 prevents too much water from being supplied to the drum.

In comparison, the process of supplying the additive to the drum will be described. The additive held in the additive holding part 450 is sprayed into the drum through the additive path 221 that is a separate one from the water supply path 220 and the additive nozzle 351 that is a separate one from the steam nozzle 250. As a result, the additive may be sprayed into the drum, not mixed with the steam.

As a result, the water is supplied to the steam generator by an external hydraulic pressure and the additive is supplied to the drum by a hydraulic pressure generated by the pump.

Here, the steam nozzle 250 and the additive nozzle 251 may be configured to be separate or to be a single nozzle (not shown). In case of the single nozzle, a steam spray hole and an additive spray hole are formed in the single nozzle, respectively. That is, such the spray holes may be in communication with the steam path and the additive path, respectively. If then, it is convenient to produce the single nozzle because steam and additive are sprayed by using the single nozzle. For example, if an opening (not shown) for the single nozzle is formed at the rear supporter 40, the production process may be simple and steam and additive may be sprayed at an optimal position.

Although not shown in the drawings, the pump 600 and the nozzle 251 for supplying the additive may be omitted. That is, the path 221 for supplying the additive may be connected with the steam path 230. In other words, it is possible to supply the additive to the drum by using the pressure for supplying steam.

When steam is supplied through the steam path 230, a sound pressure is generated and the additive is sucked through the path 221 for supply the additive. As a result, the additive is drawn in the steam path 221 and the steam and the additive are sprayed into the drum through the single nozzle 250. However, at this time the steam might be supplied to the additive holding part 450 through the path 221. Thus, it is preferable that a check valve (not shown) is provided at the additive path to prevent the steam from being supplied to the additive holding part 450. In addition, a valve (not shown) selectively closable may be provided at the additive path, because there is also necessity for selective supplying of the additive. If the valve is closed, only steam is sprayed into the drum.

As a result, additional nozzle and pump for the additive supply may not necessary because of the above configuration. However, in this case, the additive may not be supplied to the drum separately, not mixed with steam.

Accordingly, the dryer according to the present invention may have the additive and the steam supplied to the drum separately, or the additive to be supplied together when the steam is supplied.

The configuration of the single tank 400 having the water holding part 410 and the additive holding part 450 is described above. However, the water holding part 410 and the additive holding part 450 may be separate and detachable from the dryer. Also, the water holding part 410 and the additive holding part 450 may not be necessarily positioned at the same portion. For example, if the water holding part 410 is positioned at the drawer 500 as mentioned above, the additive holding part 450 may be positioned at the upper surface or a lower portion of the front surface of the dryer.

The above embodiment presents that the steam and the additive are provided inside the drum and the present invention is not limited thereto.

For example, the configuration of the steam generator 200 for generating steam in the above embodiment may be omitted. In this case, fine moisture particles instead of steam may be supplied.

Figure 2:
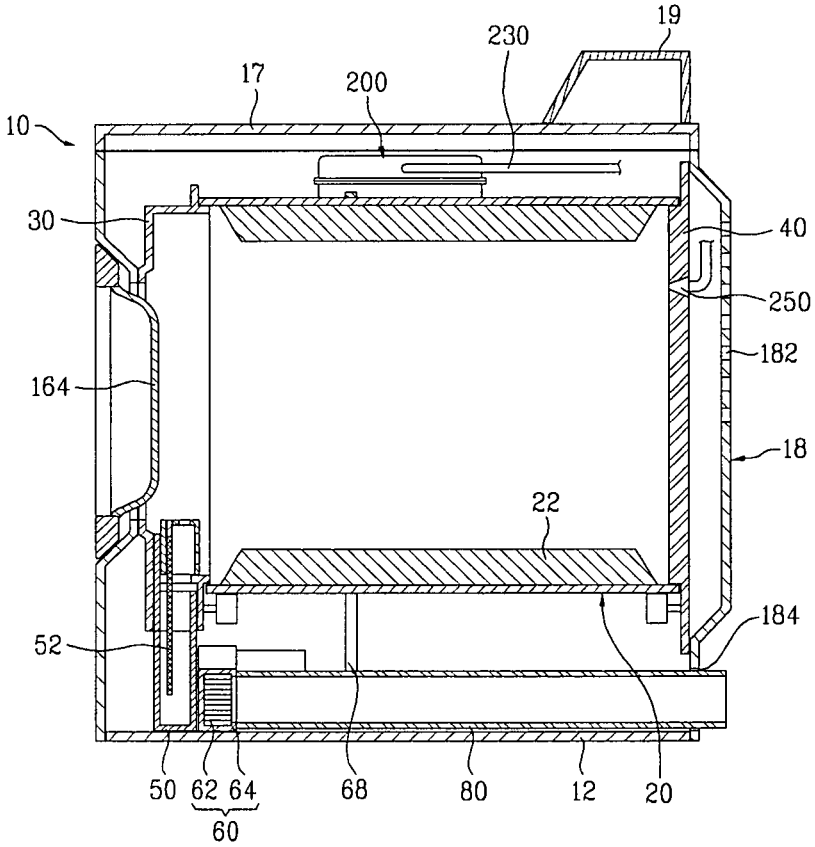
FIG. 2 is a sectional view illustrating the dryer shown in FIG. 1.
Figure 11:
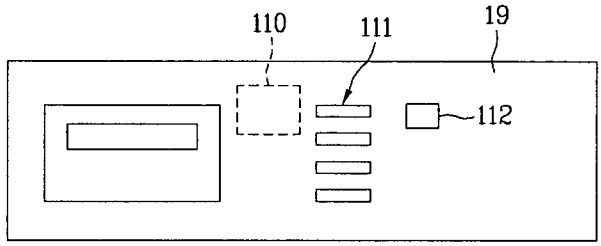
FIG. 11 is a diagram schematically illustrating a control panel of the dryer according to the embodiment.

FIG. 11 schematically illustrates the control panel 19 formed at a front surface of the dryer of FIG. 1.

On the dryer according to the present invention may be provided a controller 110 and a control panel 19. the controller 110 controls an operation of the dryer including operations of the steam supply device, the moisture supply device, a control panel 19, the additive supply device, the shutoff device and the air supply device. The control panel 19 is for an interface with the user.

A selection part 111 is provided at the control panel 19 and a user may select various drying courses by using the selection part 111. The selection part may be configured of a dial knob or the selection part may include buttons for the user to select drying course and auxiliary drying options. The drying courses include a steam course having a steam cycle to supply steam to the drum 120 when the user selects a steam course. Such the steam cycle may be an option of the drying course. In addition, as mentioned above, fine moisture particles and hot air may be supplied to the drum when the user selects a cycle similar to the steam cycle.

An additive selection part 112 may be formed at the selection part 111 for a user to select whether the additive is sprayed into the drum. That is, a user may select whether the additive is supplied to the drum. However, according to embodiments, such the additive selection part 112 may not be needed. That is, when steam or fine moisture particles are supplied to the drum, the additive may be supplied to the drum automatically.

Next, an operation of the dryer having the above configuration will be explained. Here, the additive selection part 112 is provided.

If a user selects a steam course through the election part 111, the controller 110 controls the water supply valve 281 and the steam generator 200 to generate steam. Especially, if the user wishes to spray the steam together with the additive, the user may select the additive selection part 112. If the user selects the additive selection part 112, the controller 110 controls the pump 600 for the additive to be sprayed into the drum.

Since the additive is sprayed together with the steam, the additive may be sprayed to the laundry uniformly and its function may be functioned efficiently.

Figure 12:
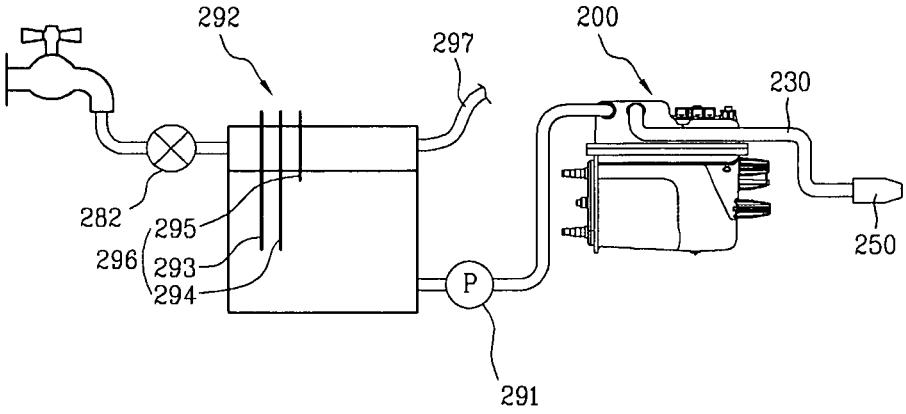
FIG. 12 is a diagram illustrating a dryer according to a still further embodiment.

Next, in reference to FIG. 12, a still further embodiment will be explained. In this embodiment, a configuration for preventing too much water from being supplied to the drum is different from the above embodiment. Thus, the configuration for supplying the additive is identical to or similar to that of the above embodiment.

A water tank 292 is provided in the cabinet and water is held in the water tank 292. The water tank 292 is connected with an external water supply source such as a water tap through a water supply valve 282. A water level sensor 296 is provided in the water tank 292 to sense a water level. The water level sensor includes a common electrode 293, a high level electrode 295 and a lower level electrode 294. This structure may be identical to the water level sensor of the steam generator described before.

The water tank has a water drain hole at an upper portion thereof. The water drain hole is connected to a water drain path 297. In this embodiment, the water drain hole is positioned beyond a water level that is able to be sensed through the high level electrode.

A process of supplying water to the water tank will be explained.

The controller opens the water supply valve 282 to allow water to be supplied to the water tank. If it is identified that a water level in the water tank reaches a high level, the water supply valve 282 is closed. At this time, the water supply might be performed continuously over the high level because of errors. The over-supplied water is drained outside the dryer through the water drain hole and the water drain path, which may not result in water leakage. The errors may be, for example, failures of the water supply valve or failures of the water level sensor.

Here, although not shown in the drawing, the water drain path may be connected with an external drain pipe. Alternatively, the water drain path may be connected with the water drain path of the dryer. The water drain path typically includes a water drain pump and a water drain hose. Alternatively, the water drain path may be connected with a tub.

As a result, the water is prevented from being supplied too much because of the water tank 292 and the water drain path 297. The shutoff device according to this embodiment includes the water tank 292 and the water drain path 297.

The water held in the water tank is supplied to the steam generator 200 by an operation of a pump 291. The controller operates the pump to supply water to the steam generator in order to use steam. If the pump 291 is not operated, the water is not supplied to the steam generator 200. As a result, even if the water supply valve 282 and the water level sensor 296 are out of order, the water is prevented from being supplied to the drum too much.

If it is identified that the water level of the steam generator rises up to a preset level, the pump is off. The heater of the steam generator is turned on to heat water and steam is generated. The generated steam is supplied to the drum.

As the water inside the water tank is used, the water level goes down. Then, the electric current is not applied between the low level electrode and the common electrode. In this case, the controller opens the water supply valve 282 and the water is supplied to the water tank 292 if water has to be necessarily supplied.

A water flow sensor (not shown) may be installed at a water supply hose that allows the water tank connected with the water tap and the amount of water supplied to the water tank is sensed. The water flow sensor may be an impeller type water flow sensor that is well-known. The amount of water supplied through the water supply hose is sensed by using the rotation number of the impeller. The controller receives a signal of the water flow sensor and it closes the water supply valve if a preset amount of water is reached. If the water flow sensor is used, the water tank may not include the water level sensor. If the amount of supplied water is sensed by using the water flow sensor and the amount of water supplied to the steam generator by the operation of the pump, the amount of remaining water in the water tank may be expected. The amount of remaining water in the water tank is memorized in a memory and the memorized amount may be used to control the water supply valve.

In this embodiment, the configuration of the steam generator 200 may be omitted. In this case, the fine moisture particles may be sprayed into the drum through the nozzle 250 by using the hydraulic pressure generated by the pump. In this case, a shape of the nozzle might be varied.

The water supply device according to this embodiment includes all of the configurations both to supply fine moisture particles and steam to the drum. Of course, at this time the shape of the nozzle might be changeable.

Figure 13:
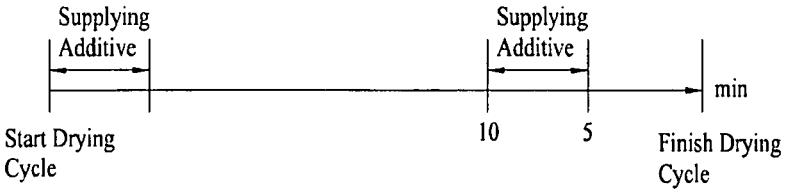
FIG. 13 is a flow chart illustrating a first embodiment of a control method of the dryer according to the embodiment.
Figure 14:
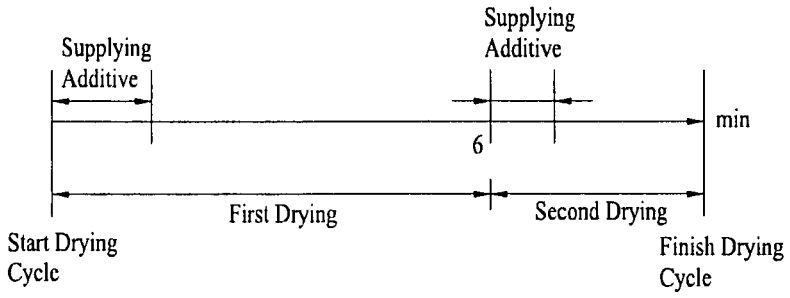
FIG. 14 is a flow chart illustrating a second embodiment of a control method of the dryer according to the embodiment.
Figure 15:
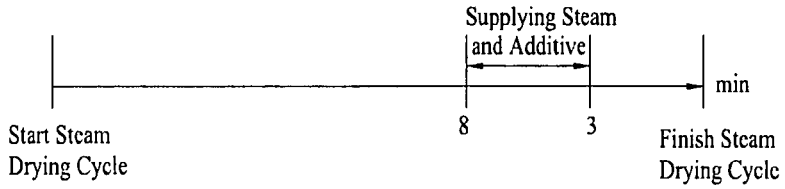
FIG. 15 is a flow chart illustrating a third embodiment of the dryer according to the embodiment.

Next, a control method of the dryer will be explained in reference to FIG. 13 to 15.

First, in reference to FIG. 13, a first embodiment of the control method will be explained.

The dryer includes a drying cycle to dry laundry by supplying hot air to laundry. Here the drying cycle is performed for a preset time period and it finishes if the drying cycle is performed over the preset time.

Such the drying cycle may be controlled to be performed according to preset flow. The preset time period may be predetermined in an initial part of the drying cycle and it is varied according to an amount of laundry.

This embodiment includes supplying the additive for smoothing the laundry to the drum in the initial part of the drying cycle, and supplying the additive for giving fragrance to the laundry in a last part of the drying cycle.

Here, an additive for smoothing and an additive for giving a fragrance to the laundry may be provided separately to be supplied to the drum. However, it is preferable that both of them are provided together on user convenience and production sake. That is, the additive includes elements for smoothing and elements for fragrance.

In addition, the additive may include elements to remove bas smell or static electricity. As a result, functions wished by consumers may be gained by supplying the additive to the drum in an appropriate time.

As mentioned above, it is preferable that the additive is supplied to the drum in the initial part of the drying cycle. That is, it is preferable that the additive is supplied to the drum in the initial part of the drying to smooth. If the drying is performed, the hot air is supplied to the drum. The hot air is high temperature enough to damage fabric of the laundry. Drying objects are tumbled in the drum or flowed to cause friction between the drying objects or between the drying objects and the drum. Because of this kind of friction, the laundry might damage.

To solve that, the additive for smoothing the laundry may be supplied and it is preferable that the additive is supplied in the initial part of the drying cycle.

As mentioned above, the additive is supplied to the drum in the last part of the drying cycle. That is, the additive is supplied to the drum in the last part of the drying cycle to give fragrance to the laundry. If the fragrance remains on the laundry after the drying cycle, a user may feel unpleasant.

Here, the fragrance might be added to the laundry because of the additive supplied to the laundry in the initial part of the drying cycle. However, as the drying performs, the effect of such the additive is getting small and it is preferable that the additive for fragrance is supplied in the last part of the drying cycle.

Here, the last part of the drying cycle means a time period between 10 min. and 5 min. prior to the completion of the drying cycle. That is, between those times, the additive for fragrance may be supplied to the drum. This is because the fragrance may not remain on the laundry if it is supplied in 10 min. after the completion of the drying cycle. In contrast, in case of within 5 min. the fragrance remains too much or the laundry may not be dried because of the fragrance.

The drying cycle includes supplying hot air to the drum and supplying cool air to the drum. Here, to maximize the effect of the additive supply, the additive may be supplied in connection with the supplying of the hot air and the supplying of the cool air.

Specifically, the supplying of the additive for smoothing the laundry may be performed in an initial part of the supplying of the hot air. After that, the additive for giving a fragrance to the laundry may be supplied during the supplying of the cool air.

The hot air may be supplied to the drum after the supplying of the additive. Alternatively, the supplying of the additive may be performed before or after the supplying of the cool air. Such the additive supplying and the hot air or cool air supplying may have a period in which both of the supplying of the additive for smoothing and fragrance are performed together.

The supplying of the hot air may include a strong hot air supply step and a weak hot air supply step. In the strong hot air supply step, the hot air is supplied with a big heating capacity and in the weak hot air supply step the hot air is supplied with a relatively small heating capacity. Here, it is premised that the motor for supplying hot air has a changeable capacity.

As a result, in the initial part of the drying cycle, the laundry is dried by using strong hot air. In the last part of the drying cycle, the laundry is dried by using weak hot air. Here, after the laundry is dried by using the weak hot air, the drying and cooling by using cool air is performed.

Such the variable capacity of the hot air is preferable for protection of the laundry. When the drying is almost complete and the moisture amount of the laundry is small, strong hot air is supplied and thus the temperature of the laundry rises drastically enough to case thermal damage.

Here, it is preferable that the supplying of the additive is performed in connection with the strong hot air supply step and the weak hot air supply step.

That is, the supplying of the additive for smoothing the laundry may be performed in an initial part of the strong hot air supplying step and after that the supplying of the additive for fragrance is performed in the weak hot air supplying step.

Of course, after the supplying of the additive, the supplying of the strong hot air may be performed, or the supplying of the additive may be performed before or after the weak hot air supplying step. Such the supplying of the additive and the supplying of the strong or weak hot air may have a period in which both of them are performed simultaneously.

If the drying cycle is performed in order of the strong hot air supplying step, the weak hot air supplying step and the cool air supplying step, the supplying of the additive for the smoothing is performed in the initial part of the strong hot air supplying step and the supplying of the additive for fragrance is performed in the cool air supplying step.

However, in any cases, the supplying of the additive for fragrance may be performed in a substantially latter part of the drying cycle, specifically, between 10 to 5 minutes before the completion of the drying cycle. Such the time may be variable according to the amount of laundry. As the laundry is lager, the amount of the additive may be controlled. The amount of the additive may be controlled by varying the time taken for the additive to be supplied. For example, if the laundry amount is large, the time for the supplying of the additive may be controlled to be longer.

If elements for removing bad smell are included in the additive, the elements can remove bas smell. If elements for removing static electricity, the static electricity as well as the supplying of fragrance is removed to relieve a user of an unpleasant feeling because of the static electricity.

Next, in reference to FIG. 14, a second embodiment of the control method will be explained.

Basically, this embodiment is identical to the above embodiment except that the time taken to perform a drying cycle is varied according the dryness of the laundry. That is, dryness of the laundry is sensed. If dryness is enough, the time for the drying is reduced. If the dryness is not enough, the time for the drying is lengthened. As a result, too much dryness and insufficient drying may be prevented in advance.

This drying cycle may include a first drying and a second drying. In the first drying, drying is performed and dryness of the laundry is sensed to vary a first drying time and after that the second drying is performed during the remaining time. 6 minutes shown in FIG. 10 is an example. For example, if the time for the initial drying is set as 50 minutes, the first drying is performed for 44 minutes and the 44 minutes may be changeable and 6 minutes for the second drying is not changeable.

Here, the first drying includes a hot air supplying step and the second drying includes a cool air supplying step. Also, the first drying may include the strong hot air supplying step and the weak hot air supplying step. Alternatively, the first drying may include the strong hot air supplying step and the second drying may include the weak hot air supplying step and the cool air supplying step. In any cases, the time for the additive supplying may be identical to the time in the first embodiment.

Next, in reference to FIG. 15, a third embodiment will be explained.

This embodiment is also identical to the above embodiments except that steam or fine moisture particles may be supplied to the laundry during the drying.

Here, the steam or the fine moisture particle may be supplied to remove wrinkles and static electricity and bad smell. The laundry is not dried completely to allow the laundry to have a preset amount of moisture. As a result, a user can iron the laundry conveniently after the drying. That is, after the laundry is dried by supplying the hot air to the laundry, steam or fine moisture particles may be provided to the laundry.

The additive according to this embodiment may be supplied before or after the steam is supplied to the laundry, or may be supplied together with the steam. Also, there may be a period in which the steam and the additive are supplied simultaneously for a preset time.

After the supplying of the s team and the additive is complete, hot air or cool air may be supplied to the drum. This is to prevent too much moisture from being supplied to the laundry because of the steam and the additive. Thus, the last part of the drying in this embodiment may be within 3 to 8 minutes before the completion of the drying, unlike the above embodiment.

It is not necessary that the hot air or cool air should be supplied to the drum after supplying the additive in the above first and second embodiment. That is, only if the drum is rotated, the additive may be supplied to the laundry uniformly. In this case, only the additive is supplied in the last part of the drying and the concern of too much moisture is removed but there might be a concern that the fragrance is evaporated because of the supplying of the hot air or cool air or the fragrance is discharged outside.

In this embodiment, the additive for smoothing the laundry may be controlled to be supplied to the drum in the initial part of the drying.

The drying cycle or the steam drying cycle in the above embodiments may be performed automatically from a start to a finish as a user selects as one of the drying courses. Alternatively, the drying cycle or the steam drying cycle may be included in various drying courses. For example, if a specific course is selected, the operation of the dryer may not be finished even after the drying cycle or the steam drying cycle and only the drum may be rotated continuously. Also, before or during the start of the drying cycle or the steam drying cycle, additional cycles may be performed as necessary. Such the additional cycles may include a case of rotating only the drum without supplying hot air, cool air, steam, fine moisture particles and variations of them.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dryer comprising:

a cabinet;

a drum in which a drying object is held, the drum being installed inside the cabinet;

an air supply device to supply hot air or cool air to the drum;

a drawer type container being detachable from the cabinet and separately movable forward and rearward in a predetermined portion of the dryer;

a tank being detachable from the drawer type container; and a moisture supply device that transforms the water and additive provided in the tank into a fine moisture particle, wherein the tank includes:

a holding part to store water to be supplied to the moisture supply device; and an additive holding part provided in the holding part to separately store additive, which is to be supplied to the moisture supply device, from the water, thereby the water and the additive being supplied to the drum separately each other, wherein the additive holding part is configured to be detachable from the dryer, and wherein the tank is indirectly mounted to or separated from the steam generator according to the forward and rearward movement of the drawer type container.

2. A dryer comprising:

a cabinet;

a drum in which a drying object is held, the drum being installed inside the cabinet;

a steam supply device to supply steam to the drum, wherein the steam supply device comprises:

a steam generator to generate steam;

a steam nozzle to spray steam generated at the steam generator into the drum; and a steam pipe to connected between the steam generator and the steam nozzle to form a steam path;

a water holding part in which water is held;

a water supply device to supply water from the water holding part to the steam generator in order to generate steam;

an additive holding part in which an additive is held;

an additive supply device to supply the additive held in the additive holding part to the drum, wherein the additive supply device comprise:

an additive nozzle to spray an additive into the drum; and an additive pipe provided between the additive holding part and the additive nozzle to form an additive path; and a drawer type container which is separately movable forward and rearward in a predetermined portion of the dryer, wherein the water holding part and the additive holding part are mounted separately at the drawer to prevent the additive from being supplied to the steam generation device and wherein the additive holding part is detachably provided inside the drawer type container, and wherein the water holding part is indirectly mounted to or separated from the steam generator according to the forward and rearward movement of the drawer type container.

3. The dryer of claim 2, wherein the steam supply device further comprises;

a pump that pumps the water held in the water holding part into the steam generator.

4. The dryer of claim 2, wherein the additive supply device further comprises, a pump that pumps the additive held in the additive holding part to generate a hydraulic pressure.

5. The dryer of claim 2, wherein the steam nozzle and the additive nozzle are configured to be separate.

6. The dryer of claim 2, wherein the steam nozzle and the additive nozzle are configured of a single nozzle.

7. The dryer of claim 6, wherein a steam spray hole to spray steam and an additive spray hole to spray an additive are formed separately.

8. The dryer of claim 6, wherein a spray hole is formed at the single nozzle to spray both steam and an additive.

9. The dryer of claim 2, wherein the water holding part and the additive holding part are detachable from the dryer.

10. A dryer comprising:

a cabinet;

a drum in which a drying object is held, the drum being installed inside the cabinet;

an air supply device to supply hot air or cool air to the drum;

a water holding part in which water is held;

a moisture supply device to supply a fine moisture particle to the drum;

a water supply device to supply water for generating a fine moisture particle from the water holding part to the moisture supply device;

an additive holding part in which an additive is held; and an additive supply device to supply the additive held in the additive holding part to the drum, wherein the additive supply device comprises;

an additive nozzle to spray an additive into the drum;

an additive pipe provided between the additive holding part and the additive nozzle to form a path; and a drawer type container which is separately movable forward and rearward in a predetermined portion of the dryer, wherein the water holding part and the additive holding part are mounted separately at the drawer to prevent the additive from being supplied to the steam generation device and wherein the additive holding part is detachably provided inside the drawer type container, and wherein the water holding part is indirectly mounted to or separated from the steam generator according to the forward and rearward movement of the drawer type container.

* * * * *